US008336140B2

(12) United States Patent
Parson et al.

(10) Patent No.: US 8,336,140 B2
(45) Date of Patent: Dec. 25, 2012

(54) AUTOMATED MULTI-FUNCTIONAL SUPPORT APPARATUS

(75) Inventors: Troy D. Parson, Ellis, KS (US); John L. Fitzsimmons, Albert, KS (US); Don Peach, Elbert, CO (US); Eric D. Boss, Ellis, KS (US)

(73) Assignee: Raye's, Inc., Ellis, KS (US)

( * ) Notice: Subject to any disclaimer, the term of this patent is extended or adjusted under 35 U.S.C. 154(b) by 1388 days.

(21) Appl. No.: 11/397,085

(22) Filed: Apr. 4, 2006

(65) Prior Publication Data

US 2006/0225212 A1 Oct. 12, 2006

Related U.S. Application Data

(60) Provisional application No. 60/668,267, filed on Apr. 4, 2005.

(51) Int. Cl.
*A61G 7/15* (2006.01)

(52) U.S. Cl. ..... 5/619; 5/611; 5/613; 5/614

(58) Field of Classification Search ..... 5/610, 611, 5/613, 614, 619; 292/338
See application file for complete search history.

(56) References Cited

U.S. PATENT DOCUMENTS 3,038,174 A * 6/1962 Brown et al. ..... 5/611
4,847,929 A * 7/1989 Pupovic ..... 5/608
5,173,002 A * 12/1992 Brennan, Sr. ..... 403/388
5,201,087 A * 4/1993 Wickham et al. ..... 5/610
5,669,090 A 9/1997 Basgall
D443,563 S 6/2001 Johnson
6,469,263 B1 10/2002 Johnson
6,505,363 B2 * 1/2003 Davis ..... 5/118
D498,712 S 11/2004 Jamison
6,862,762 B1 3/2005 Johnson

OTHER PUBLICATIONS

Camtec The Caregiver's Choice Carechair Promotion flyer, Cambridge Technologies, 1959 Church Creek Road, Church Creek, MD USA, 2004.

Stretchair brochure, STRETCHAIR, 8110 Ulmerton Road, Largo, FL 33771 USA, 2002.

* cited by examiner

*Primary Examiner* — William Kelleher
(74) *Attorney, Agent, or Firm* — Spencer Fane Britt & Browne LLP

(57) ABSTRACT

A support apparatus (10) for use in supporting a person, particularly a bariatric patient. The apparatus (10) is selectively convertible between a seat configuration for supporting the person in a substantially seated position and a table configuration for supporting the person in a substantially prostrate position. The apparatus (10) is both vertically and angularly adjustable in either configuration. The apparatus (10) includes enhanced lateral support provided by telescoping support cylinders (74,76), and substantially automatically retracting foot support portions (50).

1 Claim, 13 Drawing Sheets

AUTOMATED MULTI-FUNCTIONAL SUPPORT APPARATUS

RELATED APPLICATIONS

The present non-provisional patent application claims priority benefit of an earlier-filed provisional patent application titled "Automated Multi-Functional Wheelchair", Ser. No. 60/668,267, filed Apr. 4, 2005. The identified earlier-filed application is hereby incorporated by reference into the present application.

BACKGROUND OF THE INVENTION

1. Field of the Invention

The present invention relates broadly to wheelchairs, beds, tables, and other such person-supporting apparatuses and structures. More specifically, the present invention concerns a support apparatus for use in supporting a person, particularly a bariatric patient, wherein the apparatus is selectively convertible between a seat configuration for supporting the person in a substantially seated position and a table configuration for supporting the person in a substantially prostrate position, and wherein the apparatus is both vertically and angularly adjustable in either configuration, and wherein the apparatus includes enhanced lateral support and substantially automatically retracting foot support portions.

2. Background of the Invention

Support apparatuses and structures for bariatric patients, such as wheelchairs, beds, and tables, desirably incorporate hydraulic or other actuators to assist in positioning the patients supported by the apparatuses. More specifically, the actuators substantially automatically lift, lower, or otherwise relocate or reconfigure one or more portions of the apparatuses and thereby correspondingly position the patients, or some part of the patients, supported thereon. Unfortunately, the forces experienced by these apparatuses when accomplishing such positioning can destabilize them, potentially resulting in damage to the apparatuses or injury to the patients. Furthermore, during such relocation or reconfiguration, portions of the apparatuses can be forced into damaging contact with the ground or other surfaces.

SUMMARY OF THE INVENTION

The present invention provides a support apparatus for use in supporting a person, particularly a bariatric patient, wherein the apparatus is selectively convertible between a seat configuration for supporting the person in a substantially seated position and a table configuration for supporting the person in a substantially prostrate position. The apparatus is both vertically and angularly adjustable in either configuration, and includes enhanced lateral support and substantially automatically retracting foot support portions.

In one embodiment, the apparatus broadly comprises a patient support assembly for directly supporting, i.e., underlying, the person, a base assembly having a plurality of rolling members to facilitate moving the apparatus, and a carriage assembly interposed between the patient support assembly and the base assembly for facilitating changing the vertical height and angular disposition of the patient support assembly relative to the base assembly.

The patient support assembly includes an upper body support portion for supporting an upper body of the person, and a lower body support portion for supporting a lower body of the person. The lower body support portion includes a seat support portion, a left leg support assembly pivotably coupled with and positionable relative to a left side of the seat support portion, and a right leg support assembly pivotably coupled with and positionable relative to a right side of the seat support portion, wherein the left and right leg support assemblies are each positionable substantially independently of the other. The lower body support portion also includes a foot support portion having a left foot support portion extendably coupled with the left leg support assembly, and a right foot support portion extendably coupled with the right leg support assembly, wherein the left foot support portion and the right foot support portion are each positionable substantially independently of the other. Each of the left and right foot support portions include a tube member having a first aperture, an elongated shaft received within the tube member and having a plurality of second apertures which are each alignable with the first aperture, and a catch bolt for insertion into the first aperture and an aligned one of the second apertures in order to secure the tube member and the elongated shaft in a particular position. The first aperture and each of the second apertures has a lower cam-shaped surface and an upper catch edge surface, and the catch bolt has an insertion end which has a chamfered edge. An upward force exerted on the elongated shaft, such as can occur when the left or right foot portions move downward and strike the ground during reconfiguration of the apparatus, causes the lower cam-shaped surface to slide upwardly against the insertion end of the catch bolt and urge the catch bolt out of engagement with the upper catch edge surface, thereby substantially automatically releasing the elongated shaft to move upwardly within the tube member. The catch bolt is biased by a spring toward insertion into the first aperture and the second apertures, such that when the upward force terminates the catch bolt is substantially automatically inserted into the first aperture and a corresponding one of the second apertures.

The carriage assembly includes at least one front lift actuator extending between a front portion of the patient support assembly and a front portion of the base assembly and operable to extend and retract so as to change an amount of front separation therebetween, and at least one rear lift actuator extending between a rear portion of the patient support assembly and a rear portion of the base assembly and operable to extend and retract so as to change an amount of rear separation therebetween, wherein the front and rear actuators are independently actuatable. The carriage assembly also includes at least one support cylinder telescopically extending between the patient support assembly and the base assembly and operable to enhance at least a lateral stability of the apparatus during movement and reconfiguration. The carriage assembly also includes at least one conversion actuator extending angularly between the carriage assembly and an underside of the patient support assembly and operable to substantially automatically accomplish conversion between the seat configuration and the table configuration. The lift actuators, telescoping support cylinder, and the conversion actuator are each pivotably coupled with the patient support assembly in order to permit the necessary freedom of movement.

These and other features of the present invention are set forth in detail in the section below titled DETAILED DESCRIPTION.

BRIEF DESCRIPTION OF THE DRAWINGS

Further features of the present invention will become apparent to those skilled in the art to which the present invention relates from reading the following description with reference to the accompanying drawings, in which.

Figure 1:
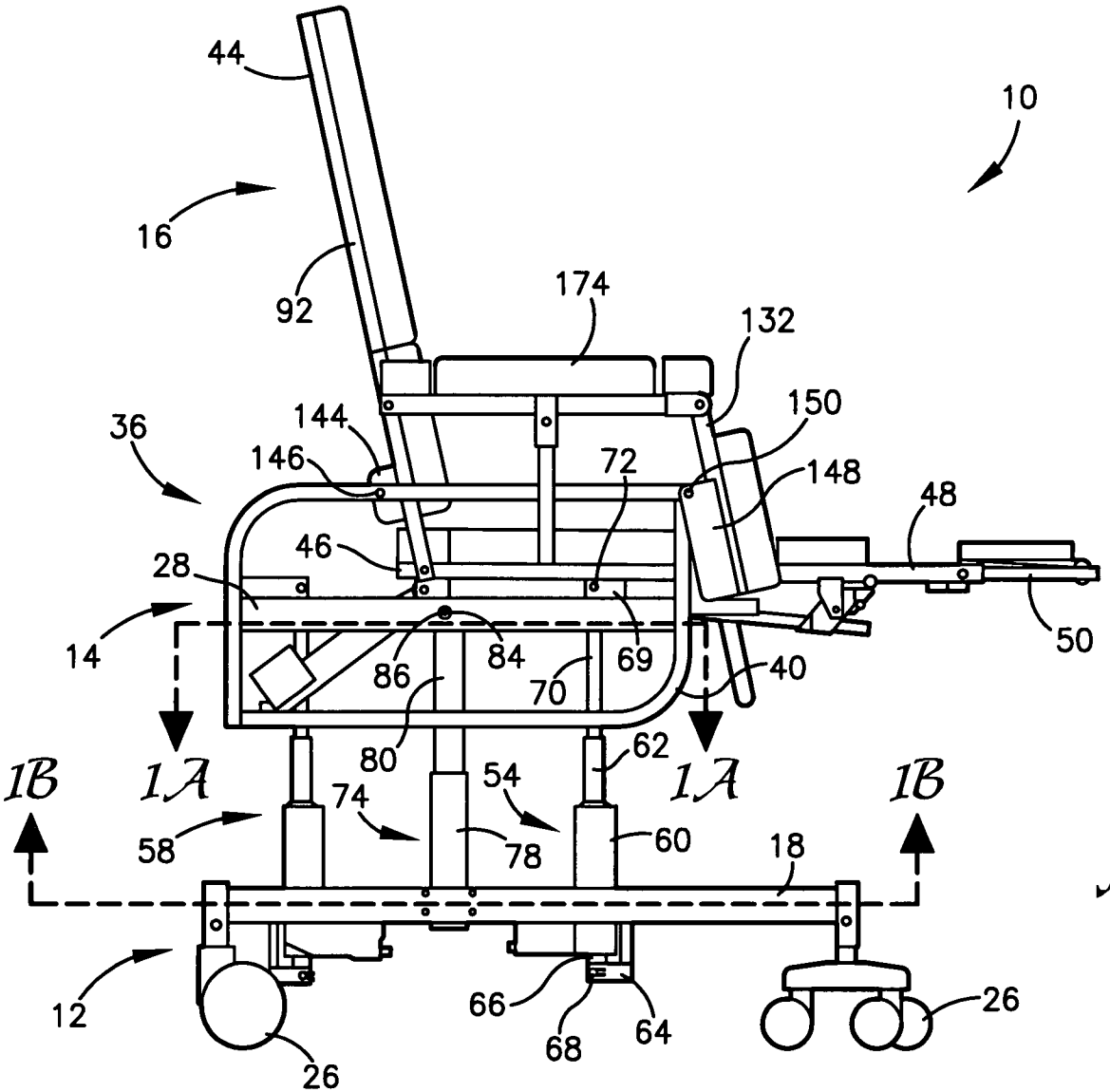
FIG. 1 is a side elevation view of a preferred embodiment of the support apparatus of the present invention.
Figure 1A:
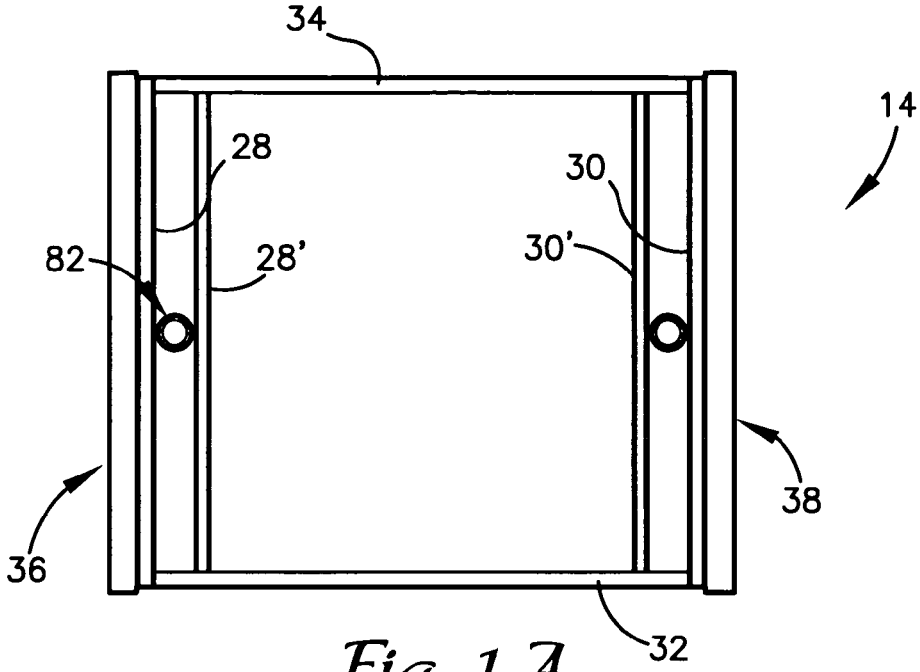
FIG. 1A is a plan view of a cross-sectional portion of a carriage frame assembly portion of the support apparatus.
Figure 1B:
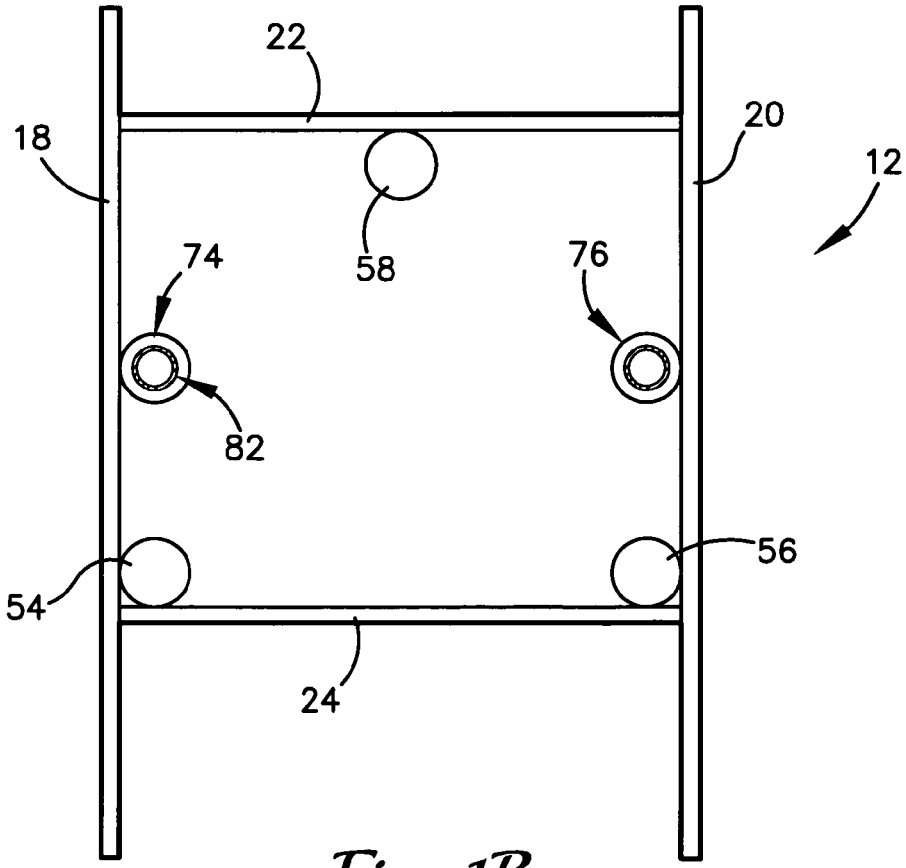
FIG. 1B is a plan view of a cross-sectional portion of a base transport frame assembly portion of the support apparatus.

For purposes of clarity in illustrating the characteristics of the present invention, proportional relationships of the elements have not been maintained in the Figures. Instead, the sizes of certain small components have been exaggerated for illustration.

DETAILED DESCRIPTION

With reference to the figures, an automated multi-functional support apparatus 10 is herein described, shown, and otherwise disclosed in accordance with a preferred embodiment of the present invention. Broadly, the support apparatus 10 is operable to support a person, particularly a bariatric patient, wherein the apparatus 10 is selectively convertible between a seat configuration (see, e.g., FIG. 1) for supporting the patient in a substantially seated position and a table, or bed, configuration (see, e.g., FIG. 8) for supporting the patient in a substantially prostrate position, and wherein the apparatus 10 is both vertically and angularly adjustable in either configuration, and wherein the apparatus 10 includes enhanced lateral support and substantially automatically retracting foot support portions.

The vertical adjustability feature of the apparatus 10 is particularly useful when, for example, it is desired to quickly and easily switch between a raised position and a lowered position without first removing the patient. Similarly, the angular adjustability feature is particularly useful when, for example, the apparatus 10 is in the seat configuration and the patient wishes to stand, in which case the apparatus 10 can be substantially automatically tilted forwardly to assist the patient's motion. The angular adjustability feature is also useful when the apparatus 10 is in the table configuration and the patient's treatment regimen requires that an end of the patient's body be elevated to promote or inhibit circulation of blood to a particular region, in which case the apparatus 10 can be quickly and easily tilted to provide such elevation.

The apparatus 10 broadly comprises a base transport frame assembly 12, a tilt carriage frame assembly 14, and a patient support frame assembly 16. In one embodiment, each of the frame assemblies 12,14,16 is constructed of a material, such as steel, or a combination of materials having sufficient strength to support expected patients' weights in the range of approximately between 400 pounds and 1200 pounds.

The base transport frame assembly 12 facilitates rolling movement of the apparatus 10, and further includes first and second side members 18 and 20, which are connected by an end member 22 and a transverse member 24. A plurality of caster wheels 26, or other appropriate rolling members, are provided at each end of the side members 18,20 to facilitate movement of the apparatus 10.

The tilt carriage frame assembly 14 facilitates converting the apparatus 10 between the seat, the table, and a variety of intermediate configurations, and facilitates changing the height and angle of the patient support frame 16 relative to the base transport frame assembly 12. The tilt carriage frame assembly 14 further includes first and second side members 28,30 and first and second end members 32,34. A first side rail assembly 36 is connected adjacent to the first side member 28, and a second side rail assembly 38 is connected adjacent to the second side member 30. Each side rail assembly 36,38 is disposed perpendicularly and exteriorly of its respective side member 28,30. Each side rail assembly 36,38 includes an outside perimeter frame member 40 formed of square metal tubing, with a side panel sheet 42 connected outboard of perimeter frame member 40.

The patient support frame assembly 16 directly supports, i.e., underlies, the person, and facilitates converting the apparatus 10 between the seat, the table, and a variety of intermediate configurations, and further includes an upper body portion 44, a seat portion 46, an upper leg portion 48, and a foot portion 50.

As mentioned, the apparatus 10 allows for substantially automated vertical height adjustment. This is accomplished by raising or lowering, as appropriate, the patient support frame assembly 16 relative to the base transport frame assembly 12. To that end, a pair of front hydraulic lift actuators 54,56 are anchored to the transverse member 24 and a rear hydraulic lift actuator 58 is anchored to the end member 22 of the base transport frame assembly 12. Each hydraulic lift actuator 54,56,58 is similarly constructed and arranged in the apparatus 10, and, therefore, for ease in explanation, only the connection of the first hydraulic lift actuator 54 will be discussed. Hydraulic lift actuator 54 includes a housing cylinder 60 having a ram 62 extendable therefrom. A first clevis 64, which is welded to the transverse member 24, receives a cylinder base stem 66 of the actuator 54. The clevis 64 and the stem 66 have correspondingly positioned apertures for receiving a pin 68 which retains the housing cylinder 60 in a supporting, yet pivoting, relationship with respect to the base transport frame assembly 12. The ram 62 projects upwardly from the housing cylinder 60 for connection with the first end member 32 of the tilt carriage frame assembly 14. A second clevis 69, which is welded to the first end member 32, receives an end 70 of the ram 62. The second clevis 69 and the ram end 70 have correspondingly positioned apertures for receiving a pin 72, which retains the ram end 70 in a supporting, yet pivoting, relationship with respect to the tilt carriage frame assembly 14. The second front hydraulic lift actuator 56 is similarly configured and connected, but positioned laterally from the first lift actuator 54 on the transverse member 24 of the base transport frame assembly 12 and the first end member 32 of the tilt carriage frame assembly 14. The rear hydraulic lift actuator 58 is similarly configured and connected, but connected to the end member 22 of the base transport frame assembly 12 and the second end member 34 of the tilt carriage frame assembly 14. Raising and lowering of the apparatus 10 is accomplished by simultaneous actuation of the front and rear lift actuators 54,56,58.

For stabilization and strength, a pair of telescoping support cylinders 74,76 are positioned at the respective midpoints of the base transport frame assembly 12 and the tilt carriage frame assembly 14. Each support cylinder 74,76 is similarly constructed and arranged in the apparatus 10, and, therefore, for ease in explanation, only the connection of the first support cylinder 74 will be discussed. A housing 78 is clamped and bolted to the side member 18 of the base transport frame assembly 12, and a telescoping member 80 projects upwardly therefrom for connection to the side member 28 of the tilt carriage frame assembly 14. In one embodiment, the side member 28 may be reinforced with a parallel side member 28' which is spaced slightly apart from the side member 28 to permit an end 82 of the telescoping member 80 to be received therebetween. Each of the side members 28,28' and a telescoping member end 82 have correspondingly positioned apertures for receiving a pin 84 which retains the telescoping member 80 in a supporting, yet pivoting, relationship to the side member 28 at a connection point 86. The second support cylinder 76 is similarly constructed and positioned at the side member 20 of the base transport frame assembly 12 and is similarly connected to the side member 30, and, in one embodiment, parallel side member 30', of the tilt carriage frame assembly 14. Thus, the tilt carriage assembly 14 is capable of pivoting in a vertical plane about the connection point 86 of the support cylinders to the tilt carriage frame assembly 14. Furthermore, the stability of the apparatus 10 is greatly enhanced during vertical movement and in its stationary position because the telescoping member 80 is braced within the housing 78 and prevents side-to-side rocking of the tilt carriage frame assembly 14 during operation that may otherwise be present when placed under the substantial patient load to which the apparatus 10 is subjected.

Figure 2:
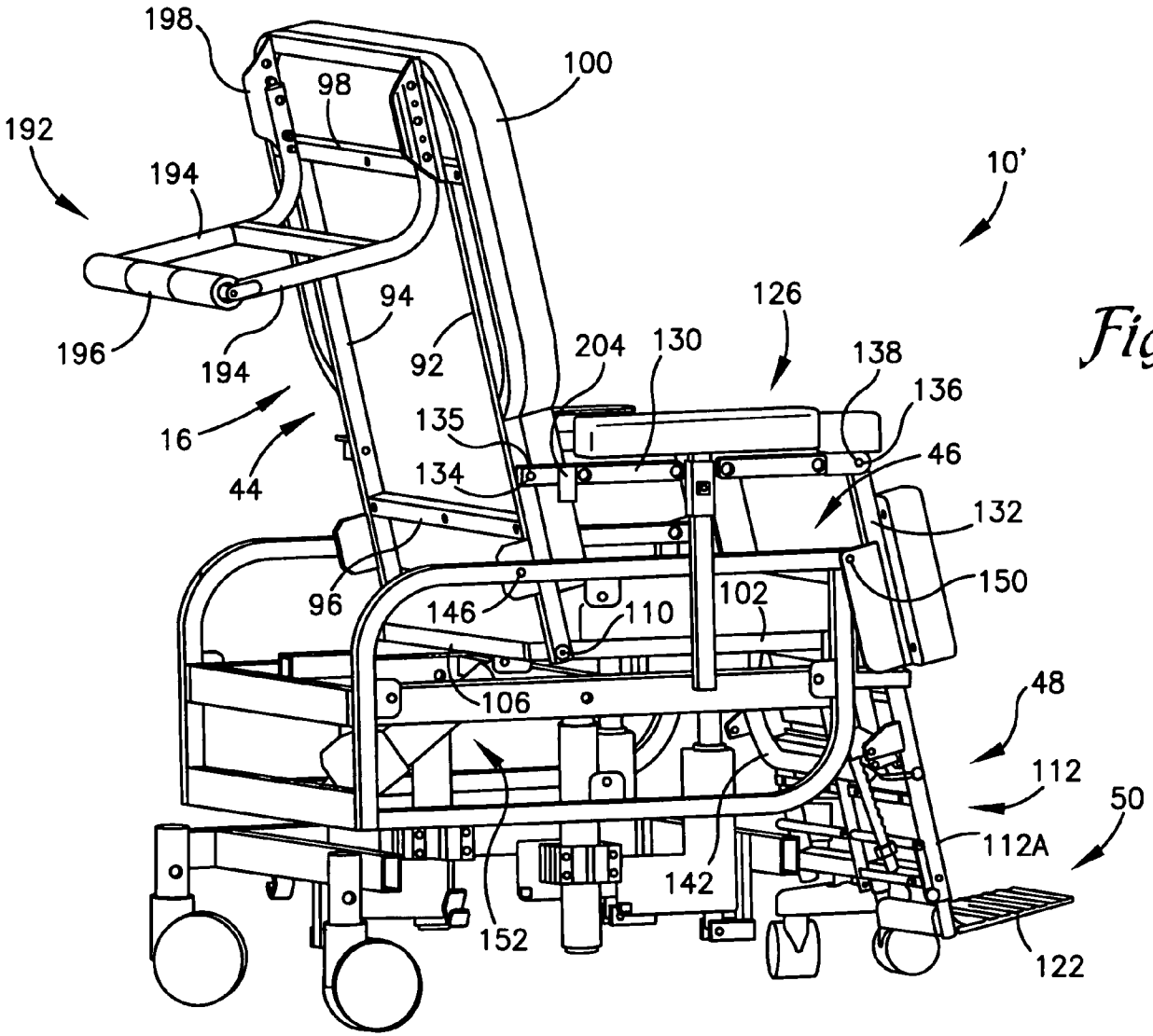
FIG. 2 is a perspective view of the support apparatus.

As mentioned, the apparatus 10 is selectively convertible between a seat configuration and a table configuration. FIG. 2 shows the apparatus 10 in a seat configuration 10'. The seated patient is in contact primarily with the patient support frame assembly 16, which, as mentioned, includes the upper body portion 44, the seat portion 46, the upper leg portion 48, and the foot portion 50. The upper body portion 44 includes first and second longitudinal frame members 92,94, first and second cross frame members 96,98, and an outer perimeter frame member 100. The seat portion 46 includes first and second longitudinal frame members 102,104, and first and second cross frame members 106,108. The upper body portion 44 is hingedly connected to the seat portion 46 as shown in FIG. 2. Corresponding apertures are provided in each of the lower ends of the longitudinal frame members 92,94 of the upper body portion 44, and the ends of the longitudinal frame members 102,104 of the seat portion 46, for receiving a pivot pin or bolt 110.

Figure 3:
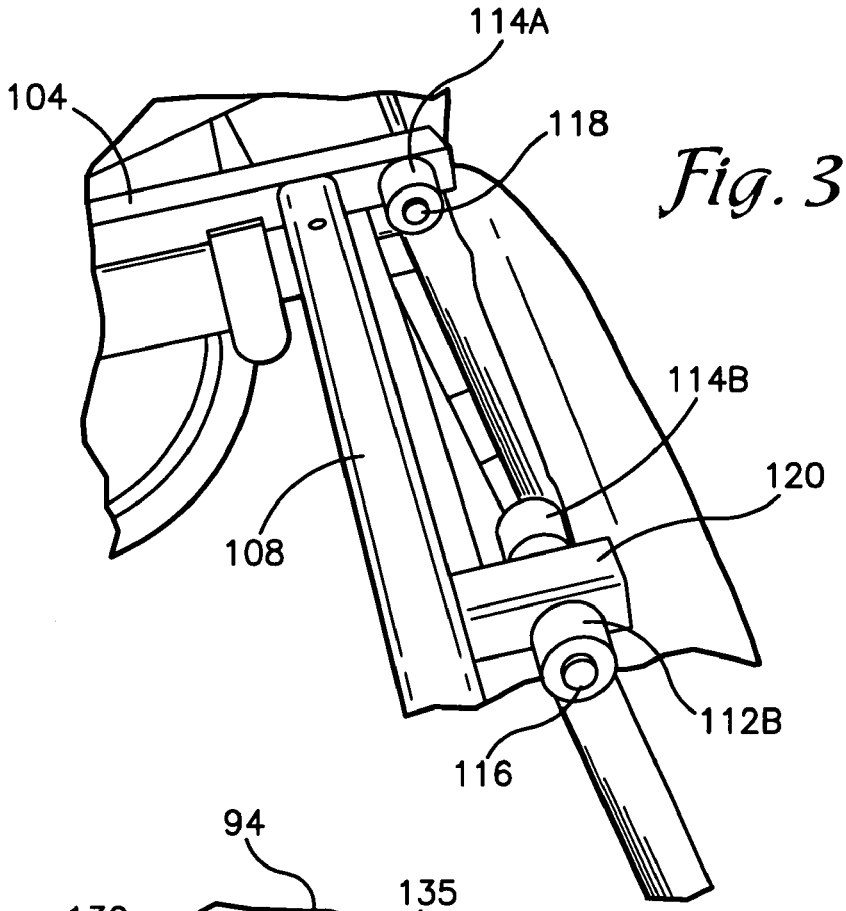
FIG. 3 is a first fragmentary perspective view of a connection between an upper leg support portion and a seat portion of support apparatus.

The upper leg portion 48 includes a pair of independently operable leg support frame assemblies 112,114, having a plurality of longitudinal frame members 112A,112B,114A, 114B. As seen in FIG. 3, a cross frame member 108 is spaced from the ends of the longitudinal frame members 102,104 of the seat portion 46, providing room on their respective ends for apertures which correspond for alignment with apertures in the ends of the longitudinal frame members 112A,114A. Pivot pins are placed through said apertures for securing the longitudinal frame members 112A,114A to the seat portion 46 at two points 116,118. A post member 120 is welded to a middle portion of the cross frame member 108, and is provided with an aperture which corresponds for alignment with apertures in the ends of the longitudinal frame members 112B,114B. A pivot pin is placed through said apertures for securing the longitudinal frame members 112B, 114B to the seat portion 46 at the post member 120. Through these connections, the leg support frame assemblies 112,114 are independently pivotable with respect to the seat portion 46, and one leg support frame assembly may remain stationary while the other leg support frame assembly is pivoted up and raised. The foot portion 50 includes two platforms 122,124 extending transversely from respective frame assemblies 112,114.

Figure 4:
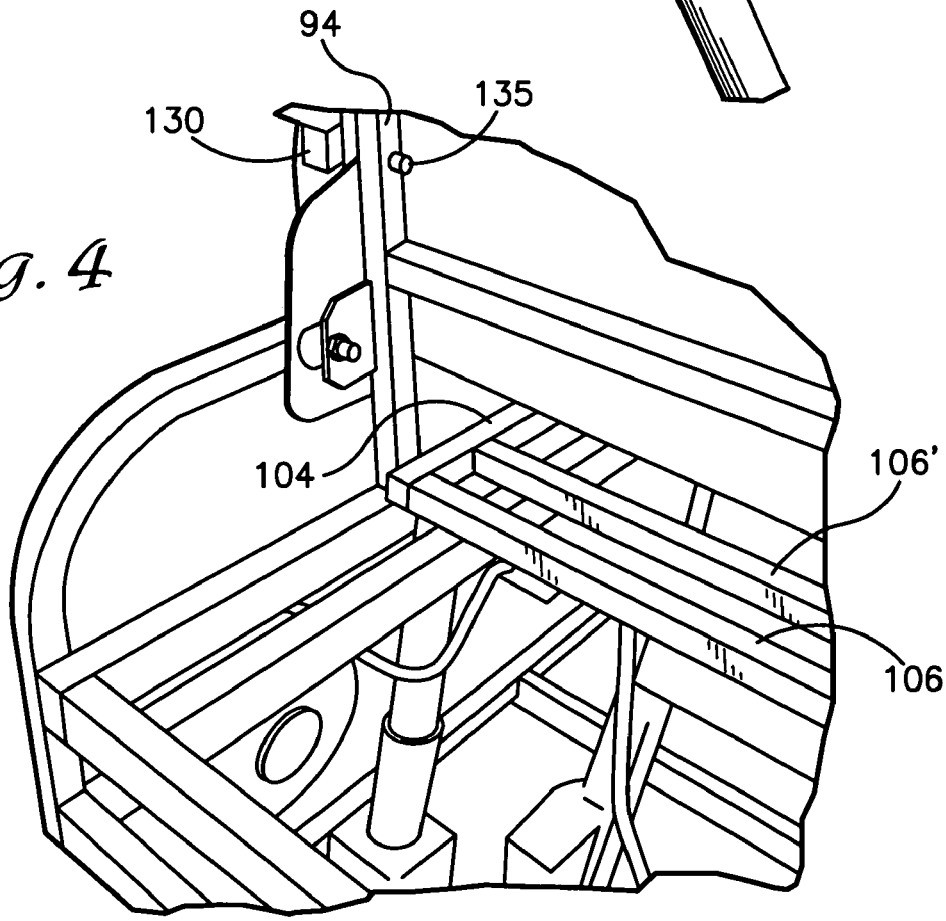
FIG. 4 is a fragmentary perspective view of a connection between an upper body support portion and seat portion of the support apparatus.
Figure 5:
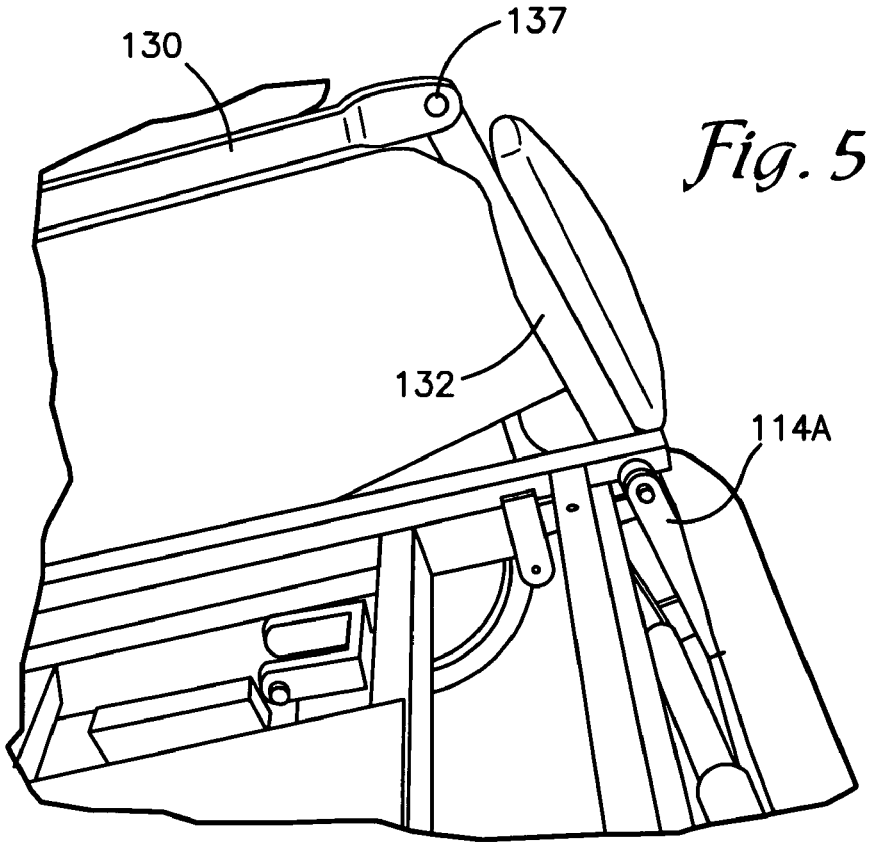
FIG. 5 is a second fragmentary perspective view of the connection between the upper leg support portion and the seat portion of the support apparatus.
Figure 6:
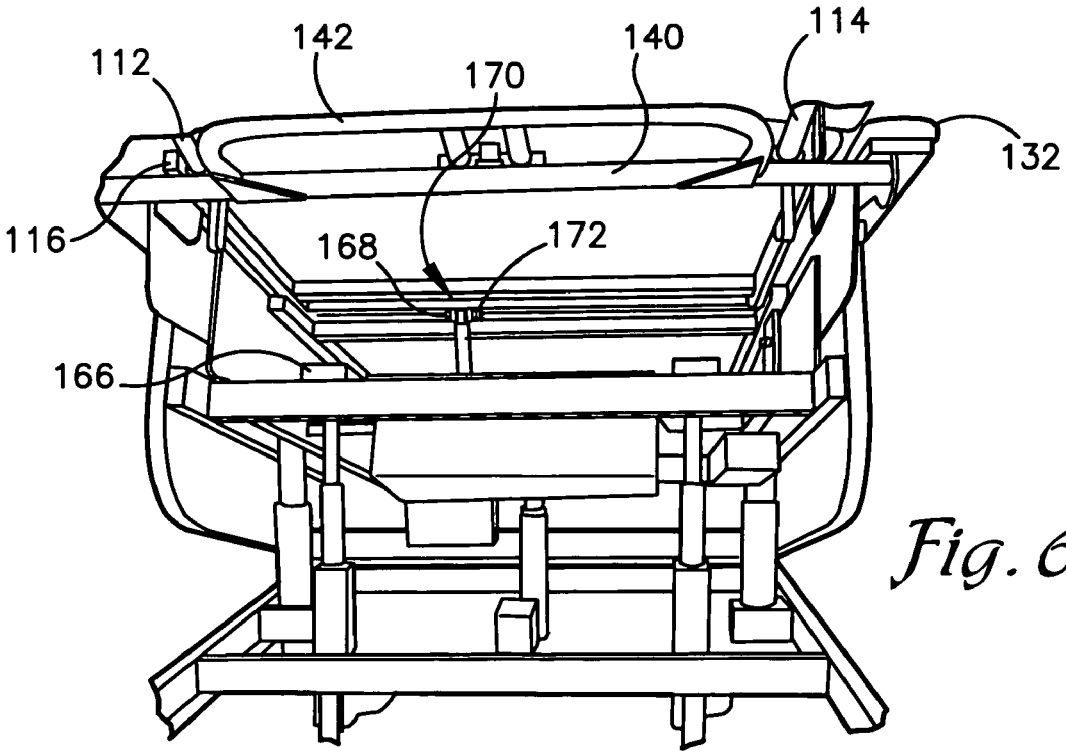
FIG. 6 is a rear elevation view of the support apparatus in a table configuration.

A pair of arm support assemblies 126,128 are provided at the sides of the apparatus 10, each including a lateral frame support 130 and a supplemental brace support 132. The lateral frame support 130 has an aperture 134,136 at each end. The first aperture 134 corresponds for alignment with an aperture (not shown) in the longitudinal frame member 92 (and longitudinal member 94 on the opposite side) of the upper body portion 44 and receives a pivot pin or bolt 135 therethrough to connect and support the lateral frame support 130 to the upper body portion 44 in a hinged relationship, as shown in FIG. 4. The supplemental brace support member 132 has an aperture (not shown) at its upper end, corresponding for alignment with the aperture 136 of the lateral frame support 130 and receives a pivot pin or bolt 137 therethrough to connect the supplemental brace support 132 to the lateral frame support 130 in a hinged relationship, as shown in FIG. 5. A cross brace 140 is welded to the lower ends of the supplemental brace support members 132 and spans therebetween. An engaging member 142 is attached to the cross brace 140, which is adapted to simultaneously engage the frame assemblies 112,114, as shown in FIG. 6. It serves a dual purpose in providing a resting brace support for the upper leg portion 48 when the apparatus 10 is in the seat configuration, and also for engaging and lifting the frame assemblies 112, 114 when converting the apparatus 10 to the table configuration. The engaging member 142 is shown as a C-shaped member which provides a depending portion for placing the engaging surface at a sufficient depth along the upper leg portion 48 and an elongated member to ensure simultaneous contact with both of the frame assemblies 112,114.

The patient support frame assembly 16 is connected to the tilt carriage frame assembly 14 at two points along each side of the apparatus 10, for a total of four points of connection. FIG. 1 shows one side of the apparatus 10, although it should be understood that the connection points on the opposite side are substantially identical. A first connection point is described as follows. A support flange 144 is provided on a lower end of the longitudinal frame member 92 of the upper body portion 44. Corresponding apertures for alignment are provided in each of the support flange 144 and the perimeter frame member 40, which receive a pin or bolt for connecting the patient support frame assembly 16 to the tilt carriage frame assembly 14 together in a pivoting relationship about a point 146. A second connection point is described as follows. A support plate 148 is provided on a lower surface of the supplemental brace support member 132. Corresponding apertures for alignment are provided in each of the support plate 148 and the perimeter frame member 40, which receive a pin or bolt for connecting the patient support frame assembly 16 to the tilt carriage frame assembly 14 together in a pivoting relationship about a point 150. Through these two points of connection 146,150 of the patient support frame assembly 16 to the tilt carriage frame assembly 14, on both sides of the apparatus 10, a conversion back and forth between the seat configuration and the table configuration can be made.

Figure 7:
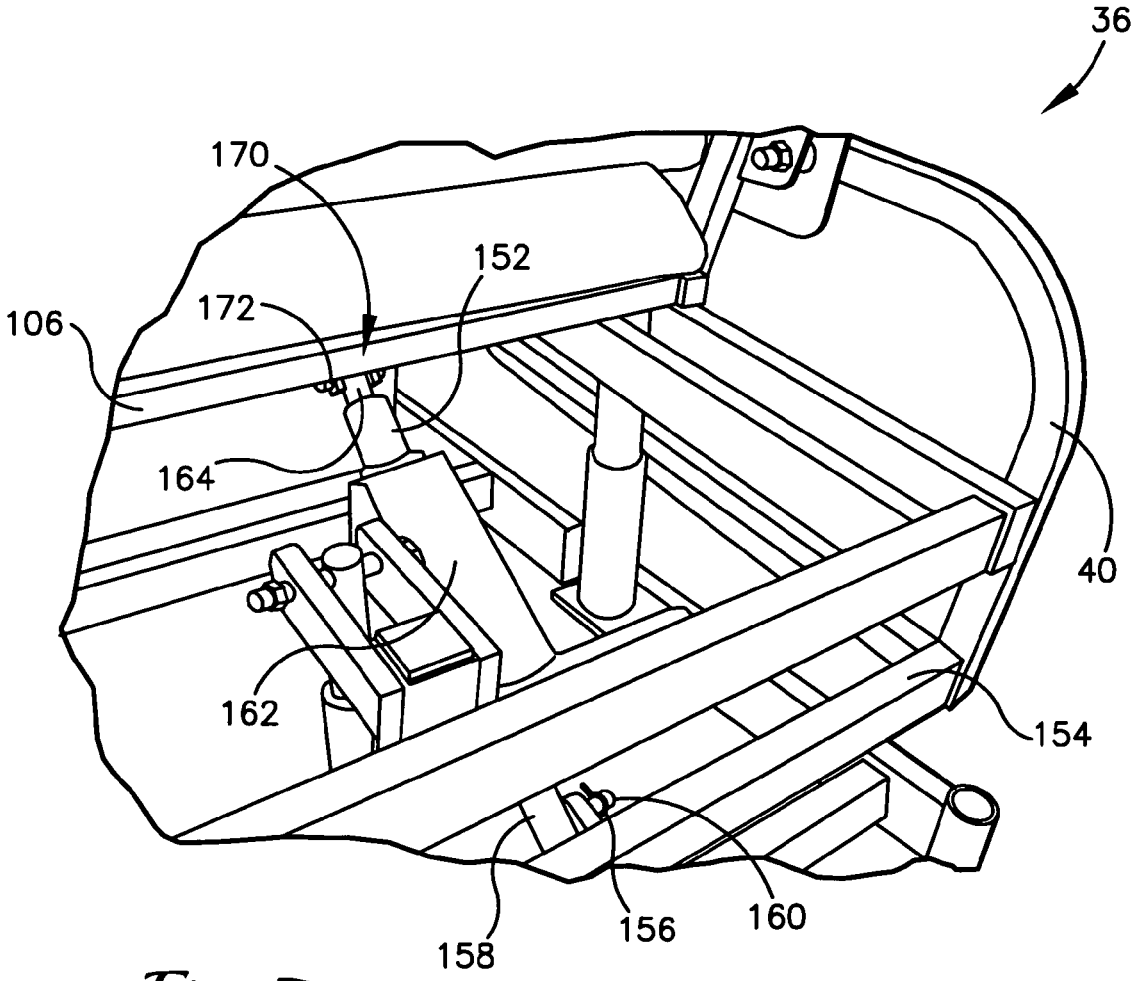
FIG. 7 is a fragmentary perspective view of a conversion actuator portion of the support apparatus.

A brace member 154 is provided at the rear of the tilt carriage frame assembly 14, and spans between the perimeter frame members 40 of the side rail assemblies 36,38, as shown in FIG. 7. A conversion actuator 152 is anchored to the brace member 154. A clevis 156, which is welded to the brace member 154, receives a cylinder base stem 158 of the conversion actuator 152. The clevis 156 and the stem 158 have correspondingly positioned apertures for receiving a pin 160, which retains the housing cylinder 162 in a supporting, yet pivoting, relationship with respect to the tilt carriage frame assembly 14. A ram 164 projects upwardly from the housing cylinder 162 for connection with the cross frame member 106 of the seat portion 46 of the patient support frame assembly 16. The cross frame member 106 may be reinforced with a parallel cross frame member 106' which is spaced slightly apart from the cross frame member 106 and provides anchoring support for a clevis 172, as further shown in FIG. 6. An end 166 of the ram 164 is received by the clevis 172, each of which have correspondingly positioned apertures for receiving a pin 168, which retains the conversion actuator 152 in a supporting, yet pivoting, relationship to the patient support frame assembly 16 at a connection point 170.

The conversion actuator 152 is therefore adapted to push and pull the patient support frame assembly 16 to accomplish pivoting about its connections 146,150 with the tilt carriage frame assembly 14. In FIG. 2, the apparatus 10' is in the seat configuration, and the upper body portion 44, the seat portion 46, the lateral frame support member 130, and the supplemental brace support member 132 assume the shape of a parallelogram. In converting the apparatus 10 from the seat configuration to the table configuration, the conversion actuator 152 pushes the seat portion 46 forward. With this action, the patient support frame assembly 16 pivots in a counterclockwise direction (as viewed from the right side of the apparatus 10) about the pivotable connection points 146,150 with the tilt carriage frame assembly 14. As the conversion actuator 152 continues to push the seat portion 46 forward, the parallelogram shape of the patient support frame assembly 16 flattens as the following pivoting actions occur (as viewed from the right side of the apparatus 10): (1) the seat portion 46 moves clockwise about the pivot point 110 with respect to the upper body portion 44; (2) the upper leg portion 48 moves counterclockwise about the pivot point 116 with respect to the seat portion 46; (3) the supplemental brace support 132 moves counterclockwise about the pivot point 137 with respect to the lateral frame support 130; (4) the upper body portion 44 moves counterclockwise about the pivot point 135; and (5) the engaging member 142 moves counterclockwise with the supplemental brace support 132 to lift the upper leg portion 48. It is to be understood that corresponding movements take place on the left side of the apparatus 10, except that the movements occur in opposite directions from those on the right side of the apparatus 10.

Figure 8:
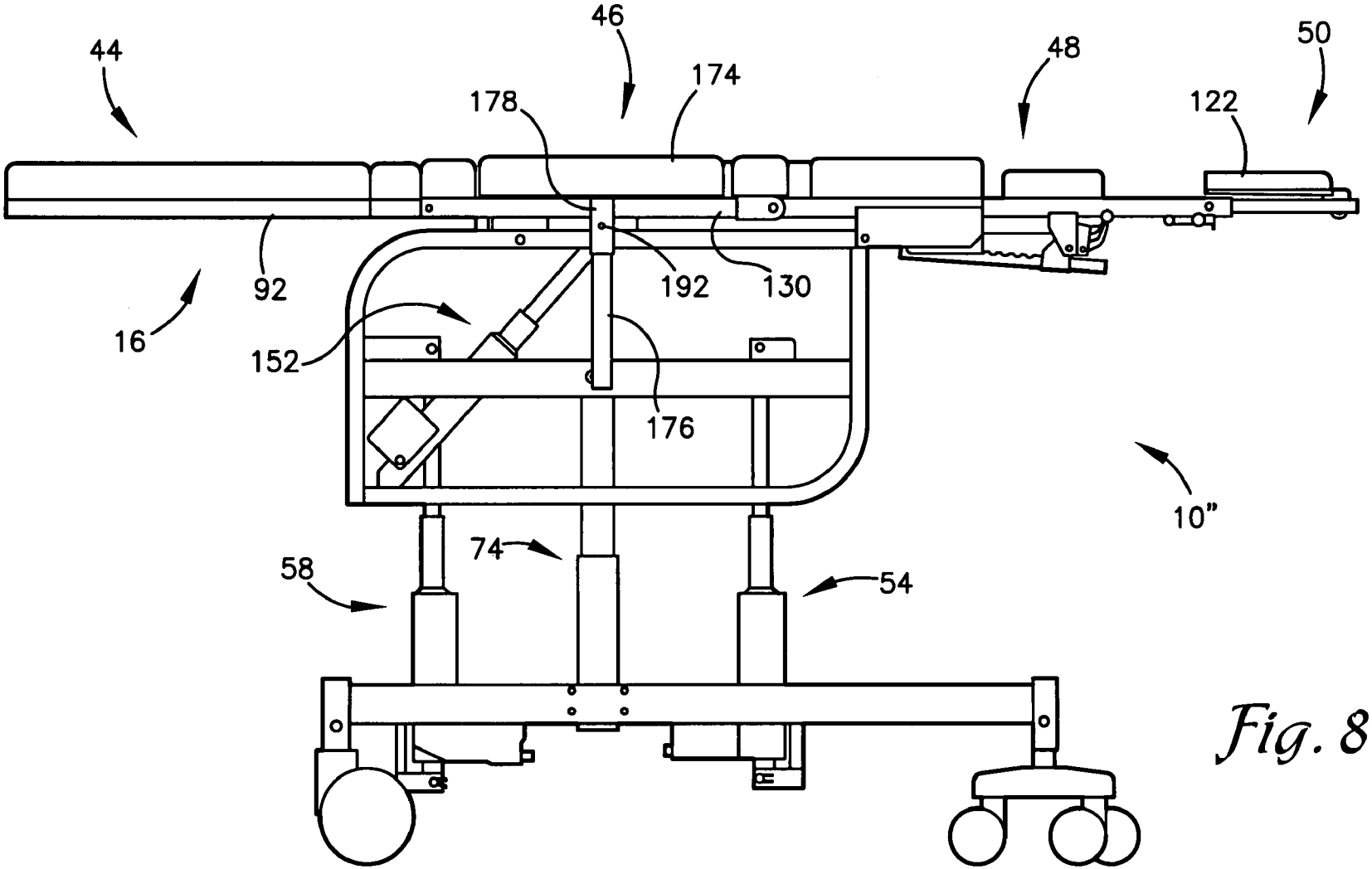
FIG. 8 is a side elevation view of the support apparatus in the table configuration.

FIG. 8 shows the recliner apparatus 10" in the table configuration. The patient support assembly 16 is collapsed into a flat, nested configuration, with the longitudinal frame member 102 of the seat portion 46 lying internally of the longitudinal frame member 92 of the upper body portion 44, and the lateral frame support member 130 lying externally of the longitudinal frame member 92. In this configuration, each of the upper body portion 44, the seat portion 46, the upper leg portion 48, and the foot portion 50 are substantially coplanar. The platforms 122,124, which are pivotally connected to the foot portion 50, can fold backward upon the foot portion 50. Padding can be placed on the underneath sides of the platforms 122,124 so that the padding faces upward for patient support when the platforms 122,124 are folded back in the table configuration.

Figure 12:
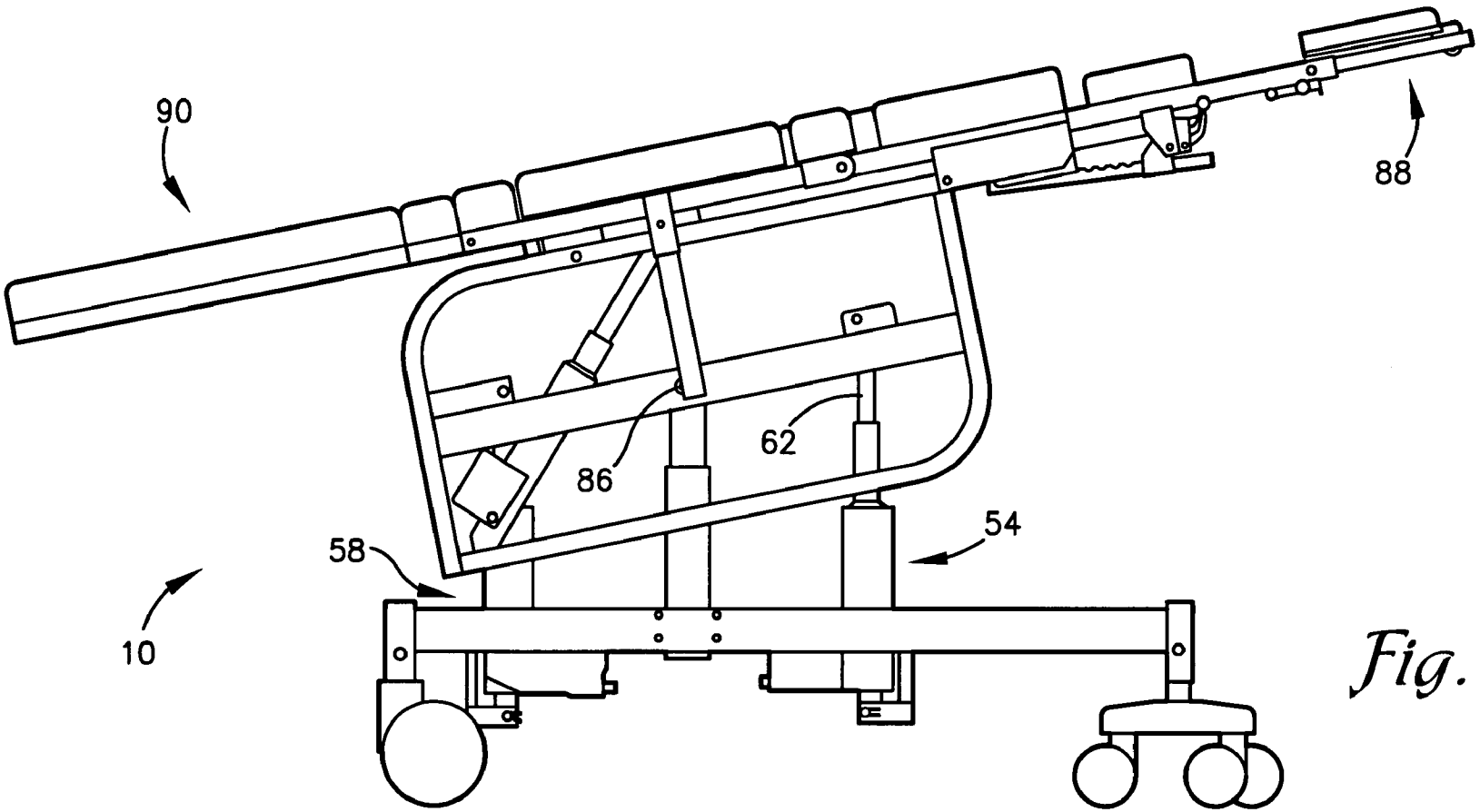
FIG. 12 is a side elevation view of the support apparatus in the table configuration and angled backward.
Figure 13:
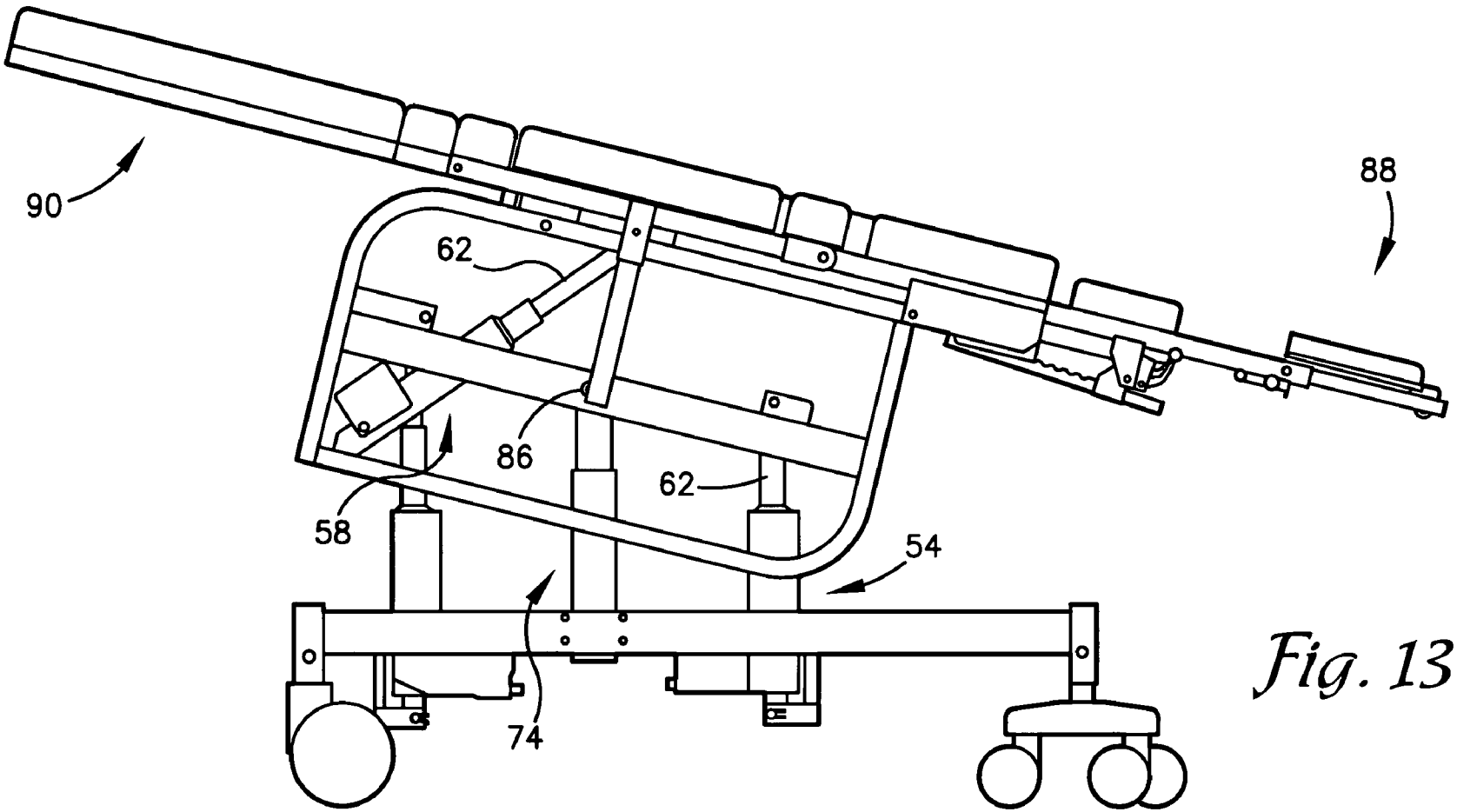
FIG. 13 is a side elevation view of the support apparatus in the table configuration and angled forward.

As mentioned, the apparatus 10 also allows for variable adjustment of the angle at which the patient support frame assembly 16 is disposed with respect to the horizontal plane, which is especially useful when the apparatus 10 is in the table configuration. The front hydraulic lift actuators 54,56 are operable independently of the rear hydraulic lift actuator 58, which permits a front end 88 (corresponding to the foot end of the patient) of the apparatus 10 to be raised or lowered relative to the rear end 90 (corresponding to the head end of the patient). For example, FIG. 12 shows the apparatus 10 in a "trend" position, in which the front end 88 of the apparatus 10 is elevated higher than the rear end 90. This is accomplished by extending the ram 62 of each of the front hydraulic lift actuators 54,56 to a determined length, while keeping the ram 62 of the rear hydraulic lift actuator 58 at a constant position or at an extended length which is less than the extended length of the rams 62 of the front hydraulic lift actuators 54,56. As the rams 62 of the front hydraulic lift actuators 54,56 extend, they lift the end member 32 of the tilt carriage frame assembly 14, which pivots about the connection point 86 with the base transport frame assembly 12. Alternatively, FIG. 13 shows the apparatus 10 in a "reverse-trend" position, where the rear end 90 of the apparatus 10 is elevated higher than the front end 88. This is accomplished by extending the ram 62 of the rear hydraulic lift actuator 58 to a determined length, while keeping the rams 62 of each of the front hydraulic lift actuators 54,56 at a constant position or at an extended length which is less than the extended length of the ram 62 of the rear hydraulic lift actuator 58. As the ram 62 of the rear hydraulic lift actuator 58 extends, it lifts the end member 34 of the tilt carriage frame assembly 14, which pivots about the connection point 86 with the base transport frame assembly 12. Depending on the patient's treatment regimen, one end of the patient's body might need to be elevated to promote or inhibit circulation of blood to a particular region. The apparatus 10 therefore permits a patient to be placed in either position, and also permits switching between positions without first removing the patient. The telescoping support cylinders 74,76 provide stability during trend-reverse trend operations to withstand potentially high torsional side-to-side forces placed on the apparatus 10.

Figure 9:
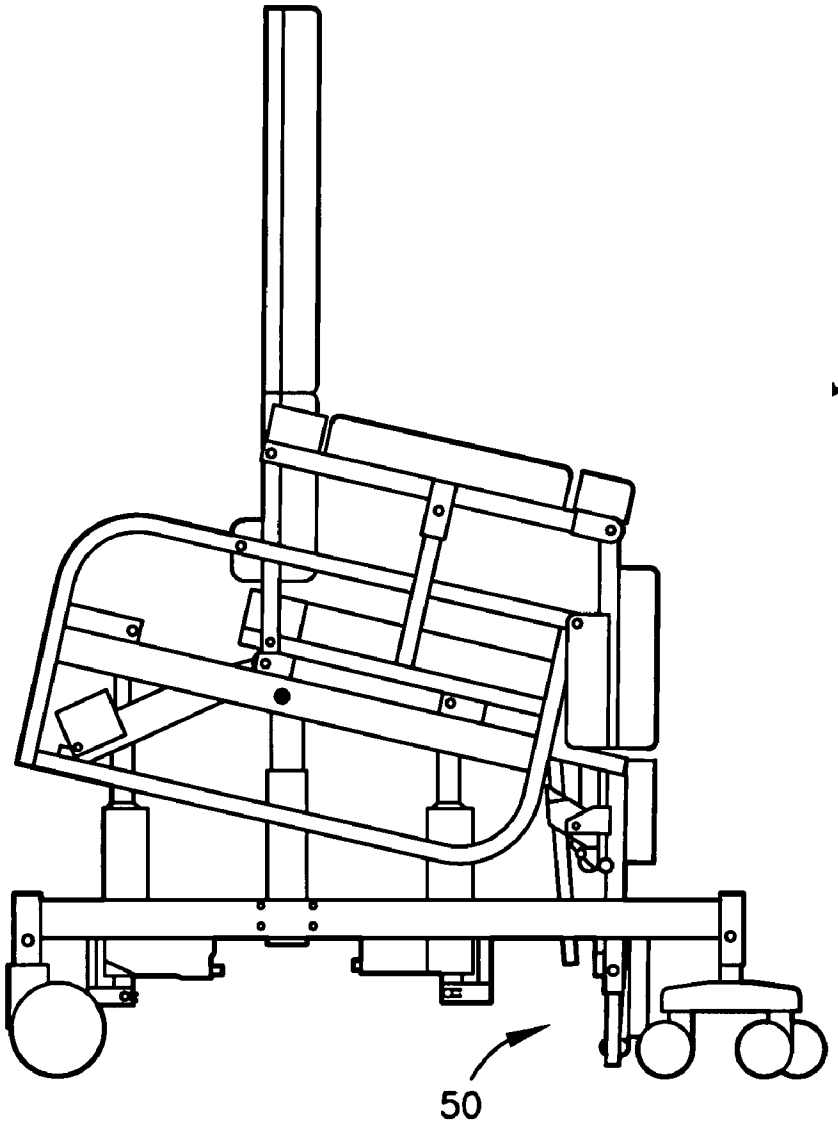
FIG. 9 is a side elevation view of the support apparatus in a seat configuration and angled forward.

The apparatus 10 can be brought back into the seat configuration by reversing the movement of the conversion actuator 152. In so doing, the pivoting actions described above are substantially reversed. Once back in the seat configuration, the front and rear hydraulic lift actuators 54,56,58 may be used as described above to tilt the apparatus 10 forward to a sufficient degree to assist the patient in getting up from the chair, as shown in FIG. 9. Although not shown, it is understood that the apparatus 10 may also be tilted backward to a reverse-trend position as can be done in the table configuration.

Figure 10:
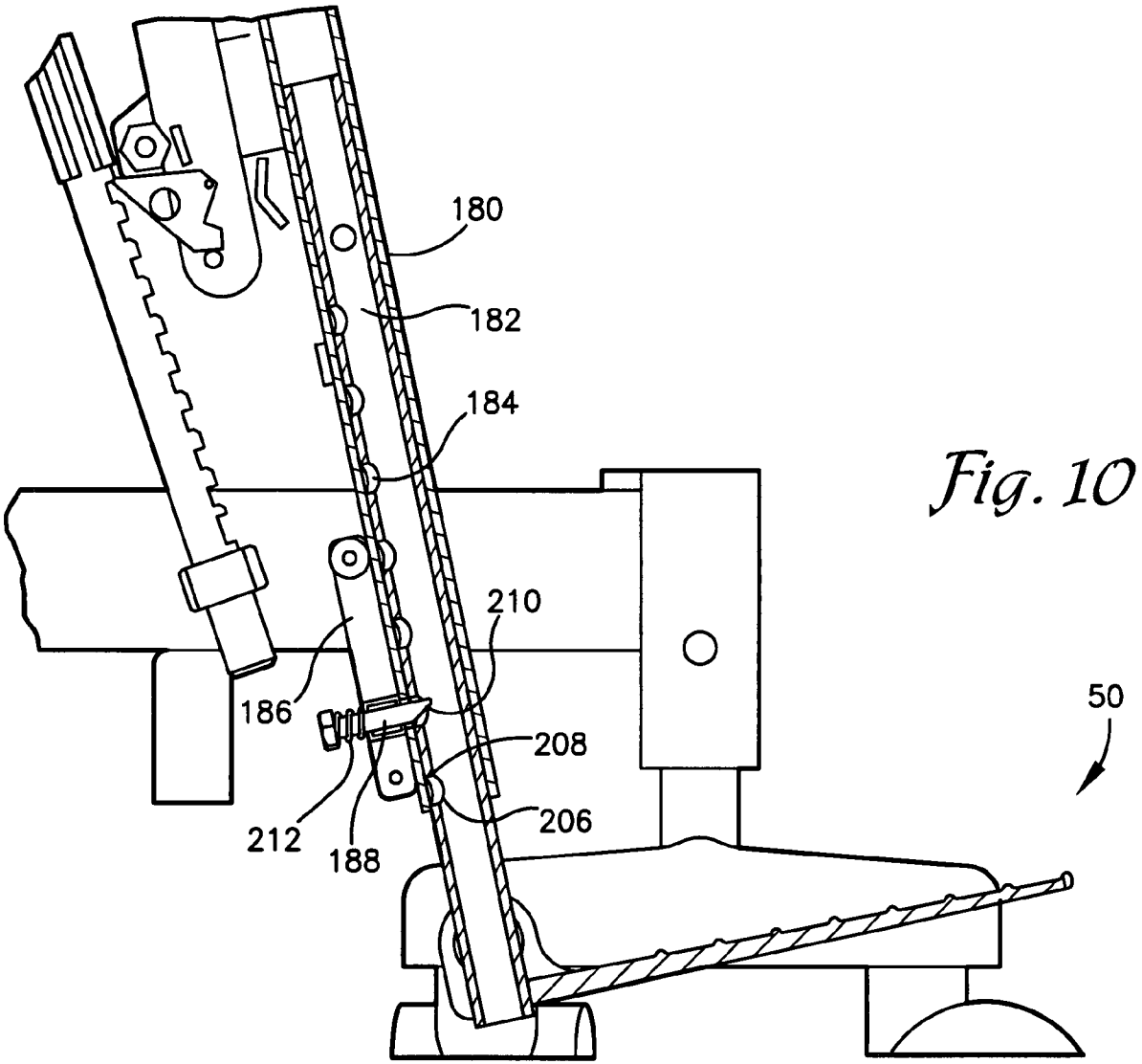
FIG. 10 is a fragmentary side elevation view, in partial cross-section, of a foot portion of the support apparatus.
Figure 11:
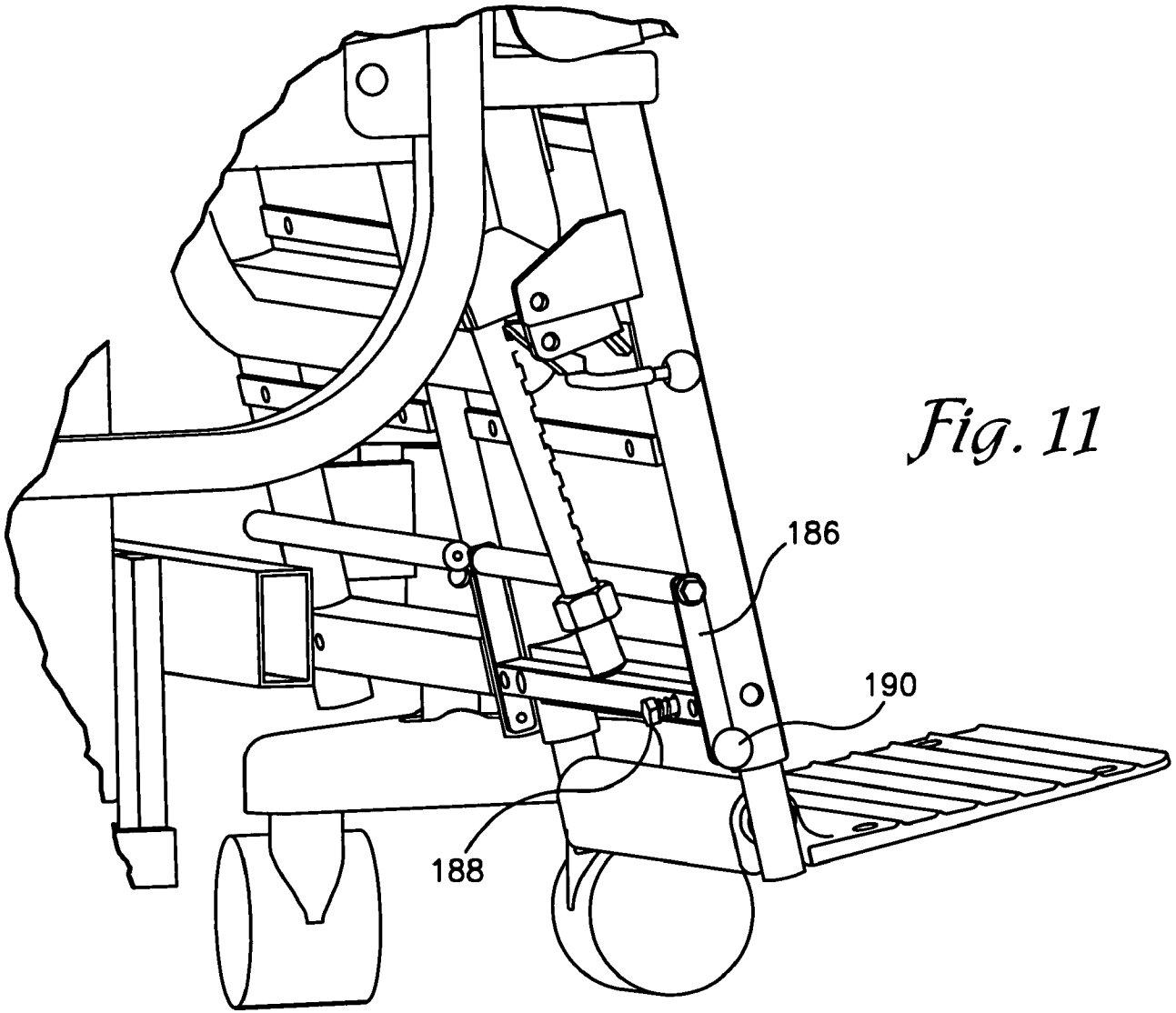
FIG. 11 is a fragmentary perspective view of the foot portion of the support apparatus.

It may be further necessary to lift or extend the foot portion 50 on occasion when lowering the apparatus 10 from an elevated position, or when tilting the apparatus 10 when in the seat configuration. The foot portion 50 further comprises a tube member 180 which receives an elongated shaft 182, as shown in FIG. 10. The shaft 182 has a series of spaced apertures 184 disposed along its length and the tube member 180 has an aperture disposed towards its lower end for alignment with the apertures 184. A spring-loaded bracket 186 having a spring-engaged catch bolt 188 is disposed on the foot portion 50 for engagingly aligning and locking the elongated shaft 182 in the tube member 180. To adjust the relative length of the foot portion 50, the bracket 186 is disengaged to free the catch bolt 188, permitting the shaft 182 to be repositioned within the tube member 180. The bracket 186 may be provided with a grasping knob 190 which the user can easily manipulate to draw the bracket 186 back against and to release the catch bolt 188, as shown in FIG. 11. The length of the foot portion 50 is varied simply by aligning any of the apertures 184 with the single aperture in the tube member 180 and re-engaging the catch bolt 188 to hold the shaft 182 in place. The foot portion 50 is also designed to automatically retract when it engages the ground during lowering or tilting of the apparatus 10. Each of the apertures 184 is configured to have a lower cam-shaped surface 206 and an upper catch edge surface 208. The catch bolt 188 has a chamfered edge 210. When the foot portion 50 engages the ground, upper force is exerted on the inner shaft 182 which moves upwardly relative to the tube member 180. As the cam-shaped surface 206 slides upward against the end of the catch bolt 188, it urges the catch bolt out of engagement with the upper catch edge surface 208, thereby releasing the shaft 182 to move upward inside the tube member 180. As the next lower aperture 184 on the shaft 182 moves upward into alignment with the aperture in the tube 180, a spring 212 pushes the catch bolt 188 inward where it is engageable with the upper catch edge surface 208 of the aperture 184. Once so engaged, the shaft 182 is locked against any further downward movement of the shaft 182 relative to the tube 180. Due to the cam-shaped surface 206 of the apertures 184 and the chamfered-edge 210 of the catch bolt 188, the shaft 182 can move over a length presenting a plurality of apertures until the shaft 182 reaches a sufficient length for locking into position.

The apparatus 10 further includes an adjustable armrest 174, the height of which can be modified as necessary. The armrest 174 includes an elongated shaft 176 which is slidably received within a tube channel 178 disposed on the outer edge of the lateral frame support member 130. The channel 178 is provided with a threaded aperture 192 which receives a bolt and a handle (not shown) for tightening against the shaft 176 to retain the armrest at a desired vertical position. The armrest 174 is provided on both sides of the apparatus 10.

Figure 14:
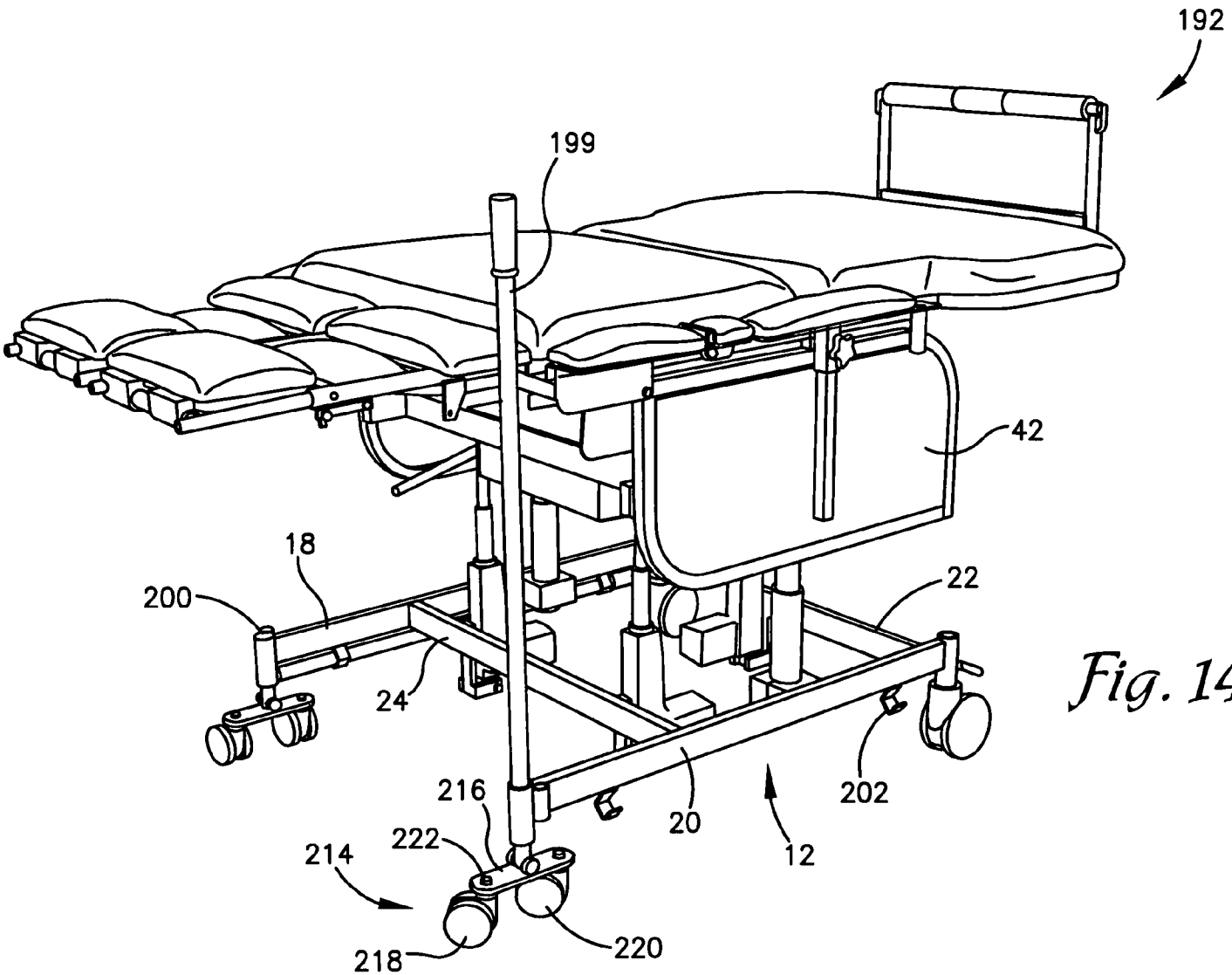
FIG. 14 is a perspective view of the support apparatus in the table configuration.

The apparatus 10 is provided with transport assistance devices. As shown in FIG. 2, a push bar assembly 192 is provided, and includes a pair of L-shaped members 194 joined at their ends by a handle bar member 196. A pair of base brackets 198 are affixed to the underneath side of the upper body portion 44 of the patient support frame assembly 16. The lower leg portions of L-shaped members 194 are provided with a plurality of apertures, which correspond for alignment with apertures on the base brackets 198 for receiving connecting pins to hold the push bar assembly 192 in place. When the apparatus 10 is in the seat configuration, the push bar assembly 192 extends transversely from the upper body portion 44 as shown in FIG. 2, providing a convenient means for pushing the apparatus 10. When the apparatus 10 is converted to the table configuration, as shown in FIG. 14, the push bar assembly 192 may be removed from its position underneath the upper body portion 44, and re-positioned such that the L-shaped members 194 rise perpendicularly above the top surface of the table so that the handle bar 196 is accessible above the table. The connecting pins securing the L-shaped members 194 to the bracket 198 are simply removed, permitting the push bar assembly 192 to be appropriately re-oriented, and then the apertures of the L-shaped members 194 are re-aligned with the apertures on the base brackets 198 for receiving the connecting pins.

In one embodiment, a guide pole 199 is included to further help guide and steer the apparatus 10 during movement. The guide pole 199 includes an elongated pole which is adapted for attachment to the base transport frame assembly 12, as shown in FIG. 14. The side members 18,20 are configured to have a vertically-disposed receiving receptacle 200 at their front ends for receiving the end of the guide pole 199. When not in use, the guide pole 199 may be conveniently stored alongside the side members 18,20 in hook brackets 202. The receptacles 200 may also be used for IV poles and the like. In one embodiment, the retaining receptacle 204 is placed on the arm support assembly 126, as shown in FIG. 2, for mounting an IV pole closer to the patient.

In one embodiment, the apparatus 10 is configured with a dual front wheel caster assembly 214, as shown in FIG. 14. It includes a bracket member 216 affixed to the base transport frame assembly 12, and caster wheels 218,220. Each of the caster wheels 218,220 are connected in tandem to the bracket member 216 in a swiveling relationship by an axle 222. The caster wheels 218,220 are spaced apart from each other so that they can swivel independently of each other without contacting each other.

The many features and advantages of the present invention are apparent from the detailed specification, and thus, it is intended to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

The invention claimed is:

1. An apparatus for use in supporting a bariatric patient having a weight of approximately between 400 pounds and 1200 pounds, the apparatus comprising:

a patient support assembly including an upper body support portion coupled with a lower body support portion;

a base assembly having a plurality of rolling members; and a carriage assembly interposed between the patient support assembly and the base assembly, the carriage assembly including:

a first powered lift actuator associated with a first end of the apparatus, and a second powered lift actuator associated with a second end of the apparatus, with each powered lift actuator extending between the patient support assembly and the base assembly and operable to change an amount of vertical separation therebetween, including allowing for overall height adjustment when actuated together, and a first support cylinder associated with a first side of the apparatus, and a second support cylinder associated with a second left side of the apparatus, with each support cylinder telescopically extending between the patient support assembly and the base assembly and operable to enhance at least a lateral stability of the support apparatus.

* * * * *

UNITED STATES PATENT AND TRADEMARK OFFICE

CERTIFICATE OF CORRECTION

PATENT NO. : 8,336,140 B2
APPLICATION NO. : 11/397085
DATED : December 25, 2012
INVENTOR(S) : Troy D. Parson et al.

It is certified that error appears in the above-identified patent and that said Letters Patent is hereby corrected as shown below:

In the Claims:

In Claim 1, Column 10:

line 55, after the first occurrence of the word first insert --unpowered--;

line 56, after the word second insert --unpowered--;

line 58, at the beginning of the line insert --unpowered-- before the word support.

Signed and Sealed this
Twenty-fifth Day of June, 2013

Teresa Stanek Rea
*Acting Director of the United States Patent and Trademark Office*